US010794036B2

(12) United States Patent
Doyle

(10) Patent No.: US 10,794,036 B2
(45) Date of Patent: Oct. 6, 2020

(54) EXCAVATOR QUICK HITCH WITH MULTIPLE MOUNTING POSITION ARRANGEMENTS

(71) Applicant: Ken Doyle, Bray (IE)

(72) Inventor: Ken Doyle, Bray (IE)

( * ) Notice: Subject to any disclaimer, the term of this patent is extended or adjusted under 35 U.S.C. 154(b) by 53 days.

(21) Appl. No.: 15/634,754

(22) Filed: Jun. 27, 2017

(65) Prior Publication Data

US 2018/0002888 A1 Jan. 4, 2018

(30) Foreign Application Priority Data

Jul. 1, 2016 (GB) ..... 1611531.3
Sep. 16, 2016 (GB) ..... 1615793.5
Jan. 27, 2017 (GB) ..... 1701338.4

(51) Int. Cl.
*E02F 3/36* (2006.01)
*E02F 3/96* (2006.01)

(52) U.S. Cl.
CPC ..... *E02F 3/3609* (2013.01); *E02F 3/961* (2013.01)

(58) Field of Classification Search
CPC ..... E02F 3/3609; E02F 3/3622; E02F 3/964
See application file for complete search history.

(56) References Cited

U.S. PATENT DOCUMENTS 4,033,601 A * 7/1977 Lindahl ..... B60D 1/46 280/490.1
4,100,688 A * 7/1978 Grist ..... E02D 3/026 172/254
4,669,187 A * 6/1987 Pardoe ..... B23D 17/06 144/34.5
4,848,012 A * 7/1989 Zimmerman ..... E02F 3/30 172/784
4,948,328 A * 8/1990 Busch ..... E02F 3/3636 172/273
5,456,028 A * 10/1995 Larson ..... E02F 3/962 172/699
5,487,230 A * 1/1996 Weyer ..... E02F 3/3604 37/403
6,047,475 A * 4/2000 Tyrrell ..... E02F 3/965 241/101.73
6,067,736 A * 5/2000 Willis ..... A01B 13/02 172/139
6,163,988 A * 12/2000 Pratt ..... E02F 3/3609 37/468
6,312,212 B1 11/2001 Burlew, Jr.
6,662,681 B2 * 12/2003 Crane ..... E02F 3/3613 248/200
6,776,571 B2 * 8/2004 Riffle ..... B66F 9/065 37/468
7,080,469 B2 7/2006 Ganswich
7,770,311 B2 * 8/2010 Hahnel ..... E02F 3/3609 37/403

(Continued)

*Primary Examiner* — Jamie L McGowan
(74) *Attorney, Agent, or Firm* — Limor Gabay

(57) ABSTRACT

An excavator quick hitch comprises a quick hitch body, the body comprising: a first mounting position arrangement for attaching an excavator attachment in a first position; and a second mounting position arrangement for attaching the, or an alternate, excavator attachment in a second position, wherein in certain embodiments, the quick hitch (also sometimes called a 'quick coupler' in various countries) can facilitate mounting of more than one excavator attachment, at the same time.

24 Claims, 6 Drawing Sheets

(56) References Cited

U.S. PATENT DOCUMENTS

| | | | | |
|---|---|---|---|---|
| 7,779,562 | B1 * | 8/2010 | Loveless | E02F 3/3627 37/231 |
| 7,832,130 | B2 * | 11/2010 | Sederberg | E02F 3/3604 37/403 |
| 8,539,699 | B2 * | 9/2013 | Ramun | B23D 31/008 37/403 |
| 8,556,534 | B2 | 10/2013 | Lim et al. | |
| 9,284,712 | B2 * | 3/2016 | Bradley | E02F 3/3604 |
| 2002/0162251 | A1 * | 11/2002 | Underwood | E02F 3/964 37/403 |
| 2004/0244234 | A1 * | 12/2004 | Underwood | E02F 3/964 37/403 |
| 2014/0305012 | A1 * | 10/2014 | O'Donnell | E02F 3/964 37/403 |

* cited by examiner

EXCAVATOR QUICK HITCH WITH MULTIPLE MOUNTING POSITION ARRANGEMENTS

The present invention relates to improvements in or related to quick hitches for excavators.

TERMS/DEFINITIONS

'Arrangement':

The term arrangement is a technical term which means a feature, or combination of features, (usually with a given purpose). For example, a 'measuring arrangement' is a feature or features, to facilitate measuring. A 'holding arrangement' is a feature or features, to facilitate holding.

'Feature':

The term 'feature' is a broad term that includes within its scope any feature under the Sun. A feature may, for example, be an element, body, member, or may even be an aperture (ie opening/hole or the such like). Thus the term 'holding feature' includes within its scope, for example, any element, body, member, or even aperture, to facilitate holding. A 'feature' may also be a 'part' of a broader feature; for example, if a part of an invention is disclosed/claimed as comprising a 'padding feature', this does not limit the padding feature to being a separate feature that is added to the invention (eg a sponge element, adhered to the invention); the invention, for example, may have a part made of sponge, or have an inner sponge (or soft) layer—in such a case, if that part of the invention is clearly of a material/nature that provides padding, then this falls within a scope of what is defined in the present application as a 'padding feature'.

'Quick Hitch/Quick Coupler'

The present applications disclosed a quick hitch (for an excavator). It will be known to those with skill in the art that, whilst this term is often used in certain countries (such as the United Kingdom), the term 'quick coupler' (used for the same item) is often preferred in others, most notably the United States. Thus the terms are interchangeable, and applicant reserves the right to claim the quick hitch either as a quick hitch, or as a quick coupler.

BACKGROUND

Standard excavator quick hitches are designed to mimic (and facilitate) natural position of how a bucket attachment is arranged, with the bucket faced towards the excavator. If the bucket is reversed in the other direction, the hydraulic bucket cylinder of the excavator tends to already be 80% retracted, which restricts movement of the bucket. This tends to mean the bucket cannot scoop, or carry liquid concrete whilst its dipper arm/stick is close to the excavator.

Since two of the main reasons that the bucket on an excavator is reversed are so that it can transport liquid concrete from a concrete truck to a foundation trench, or so that it can excavate underneath a wall which needs to be underpinned (or excavate underneath a pipe, or duct, etc (or any other place)), not having full function of the excavator/bucket in this orientation can be frustrating, and limiting.

The standard way used by excavator operators to overcome this issue at the moment is to position the excavator the maximum distance possible away from the job at hand, and in so doing, the dipper arm/stick hydraulic cylinder can be fully retracted, giving the reversed bucket more (liquid) capacity. The problem is, a lot of sites are restricted, and there isn't enough room to achieve this method.

It is also known that some operators, in desiring to use two excavator attachments simultaneously, have physically (and bespokely) engineered/welded a second attachment (eg a rock breaker) onto an arm of an excavator. However, no known quick hitch has been provided that provides a plurality of mounting position arrangements, or facilitates use of two excavator attachments, attached/mounted simultaneously.

SUMMARY

The present invention is defined by the accompanying claims, to which reference should now be made.

Examples of the present invention seek to provide a solution to the above problem(s) by providing, a quick hitch, comprising: a quick hitch body, the body comprising: a first mounting position arrangement for attaching an excavator attachment in a first position; and a second mounting position arrangement for attaching the, or an alternate, excavator attachment in a second position.

With the two or more mounting position arrangements, there is no longer any need for operators to use the long-winded method/solution previously discussed, or to stretch out the excavator arm in such circumstances. Now, with the quick hitch solution as disclosed, the excavator arm can be used as normal, with the same result. In terms of the problem regarding excavating under a wall, pipe, duct (etc), with the inventive quick hitch disclosed, by now having full movement of the reversed bucket, these jobs are made significantly easier and a lot less dangerous, especially when working at the edge of a bus lane, road or motorway (or any other location, for example).

BRIEF DESCRIPTION OF THE DRAWINGS

Examples of the present invention will now be more particularly described, with reference to the accompanying drawings, by way of example only, in no way limiting a scope of the invention, in which.

DETAILED DESCRIPTION

Figure 1:
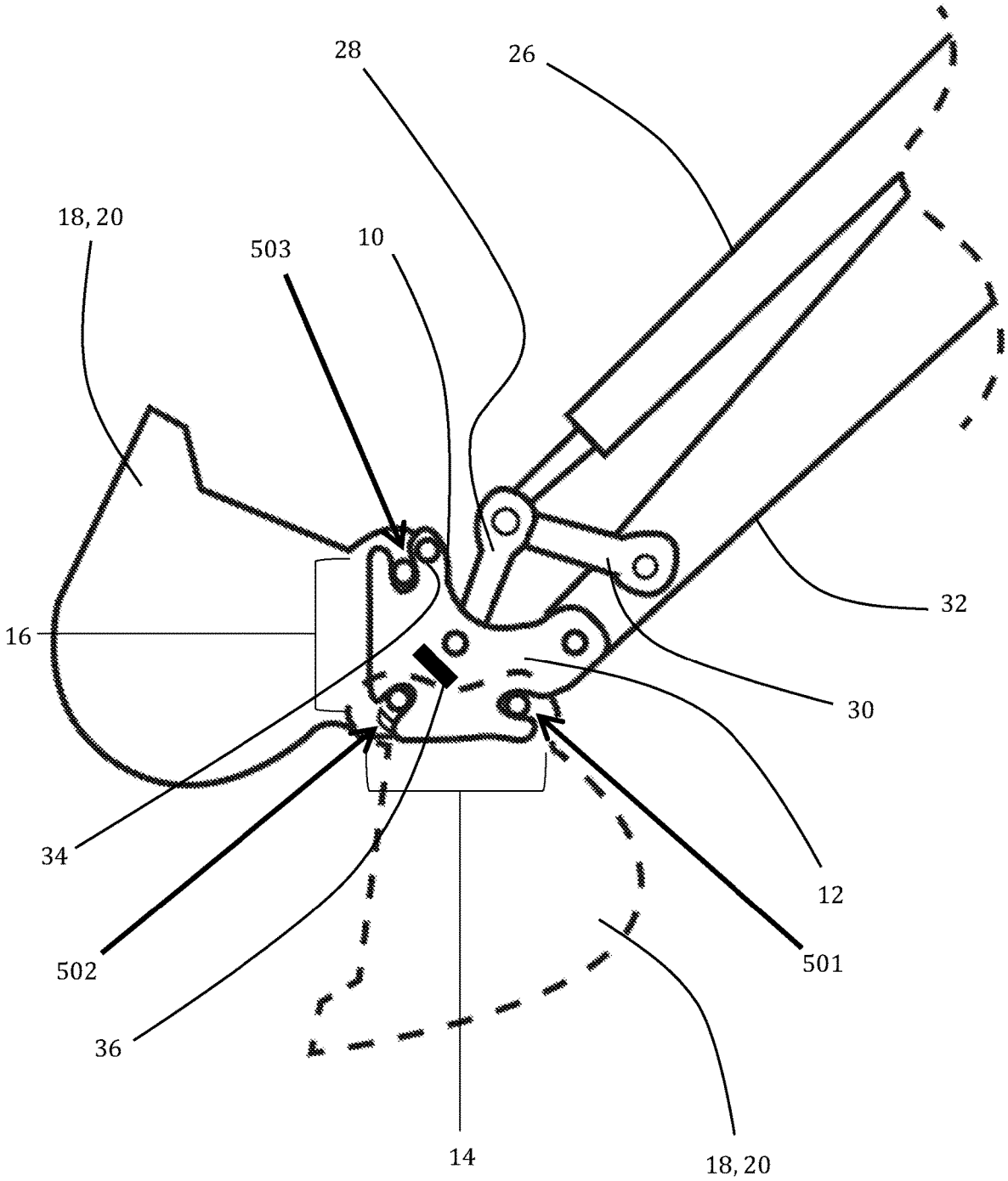
FIG. 1 is a side, cut off (ie not showing a whole excavator) view of part of an arm of an excavator, showing a quick hitch in accordance with what is claimed, showing two mounting positions the quick hitch provides.

Referring to the drawings, there is shown an excavator quick hitch 10 comprising: a quick hitch body 12, the body 12 comprising: a first mounting position arrangement 14 for attaching an excavator attachment 18 in a first position; and a second mounting position arrangement 16 for attaching the, or an alternate, excavator attachment in a second position.

In one preferred embodiment, the first mounting position arrangement 14 and second mounting position arrangement 16 are provided by way of a three attachment point arrangement, wherein the centre attachment point is used as part of the first and second mounting position arrangement. This is shown most clearly in FIG. 1 and FIG. 2 (as well as FIG. 5, and FIG. 6). In FIG. 2, a first attachment point 501, second attachment point 502, and third attachment point 503 are clearly shown. There is shown a bucket attachment mounted substantially horizontally via the quick hitch/quick coupler 10. There is also represented a bucket attachment shown mounted downwards, shown in dashed lines. What is being suggested in this Figure is that the bucket attachment shown can be mounted in either of the two positions. It is shown mounted substantially horizontally, but the dashed line version of the bucket is intended to suggest/show it can also, if so desired, be removed, and mounted in the downwards (lower) mounting position.

Figure 2:
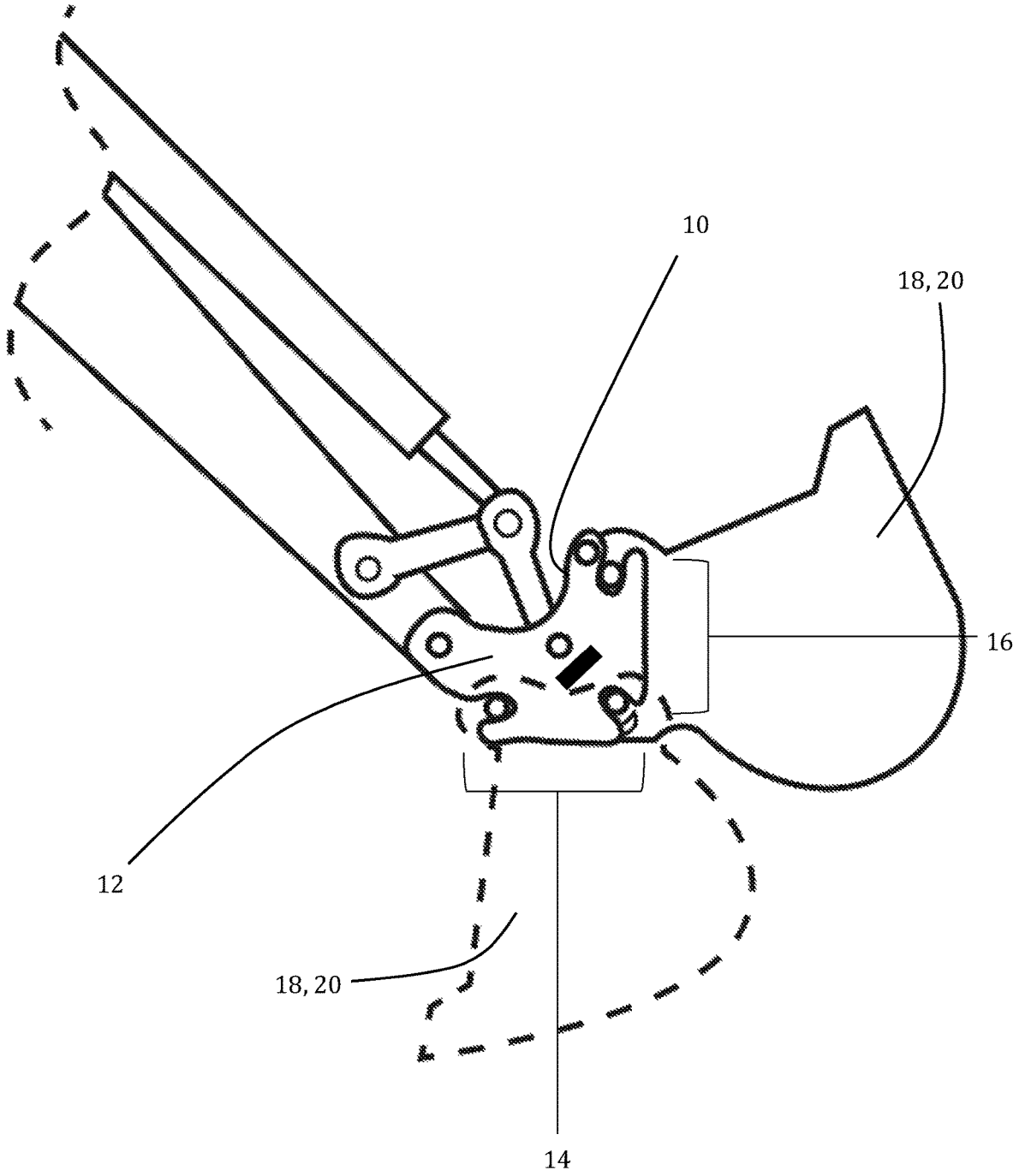
FIG. 2 is a reverse side view of the same embodiment as shown in FIG. 1, from the other side, this time showing, in a lower mounting position, an excavator bucket attachment in a standard orientation (reversed from what is shown in FIG. 1)

FIG. 1 shows the significant potential benefit(s) of the second position. For example, in FIG. 2, the (lower) bucket attachment 18, 20 mounted to the first mounting position arrangement 14 is shown in a standard orientation, faced towards the excavator (not shown). This is a useful position for scooping, for example. However, if the same bucket attachment is reversed (generating the position for the lower bucket attachment as seen in FIG. 1), it can be seen that the angle of the bucket attachment is very limited; for example, an operator would have to extend the arm of the excavator significantly in order to use the lower attachment position for scooping, (or especially for carrying) with the bucket attachment. Thus standard quick hitches wherein there is only one such mounting position arrangement (eg the lower mounting position) may be very limited/restricted in movement and/or position and/or operation of an attached attachment (such as a bucket attachment).

However, with the second position (eg as the bucket attachments are shown in FIG. 1 and FIG. 2, in the second mounting position arrangement), the bucket can be extremely useful for carrying. Bucket attachment(s) 18, 20 are simply shown by way of example only, and any other attachment(s) 18 may be used).

(The term 'attachment point' includes within its scope the term 'mounting point', which is also a good term for such points).

It is clearly shown how attachment point 501 and 502, in the example, form the first mounting position arrangement 14 (which, in the example, is a downward (lower) mounting position arrangement). It is also clear how attachment point 502 and 503, in the example, form the second mounting position arrangement 16 (which, in the example, is a substantially horizontal ((bucket) carrying) position, wherein the bucket (or any other excavator attachment) can carry a load, the term 'load' being an extremely broad term including within its scope any matter and/or thing. The matter could be, for example, solid (such as rock, for example). The matter could be, for example, a fluid.

Thus in the example of FIG. 1 and FIG. 2, the first mounting position arrangement 14 and second mounting position arrangement 16 are provided by way of a three attachment point arrangement, wherein the centre attachment point 502 is used as part of the first and second mounting position arrangement.

Figure 3:
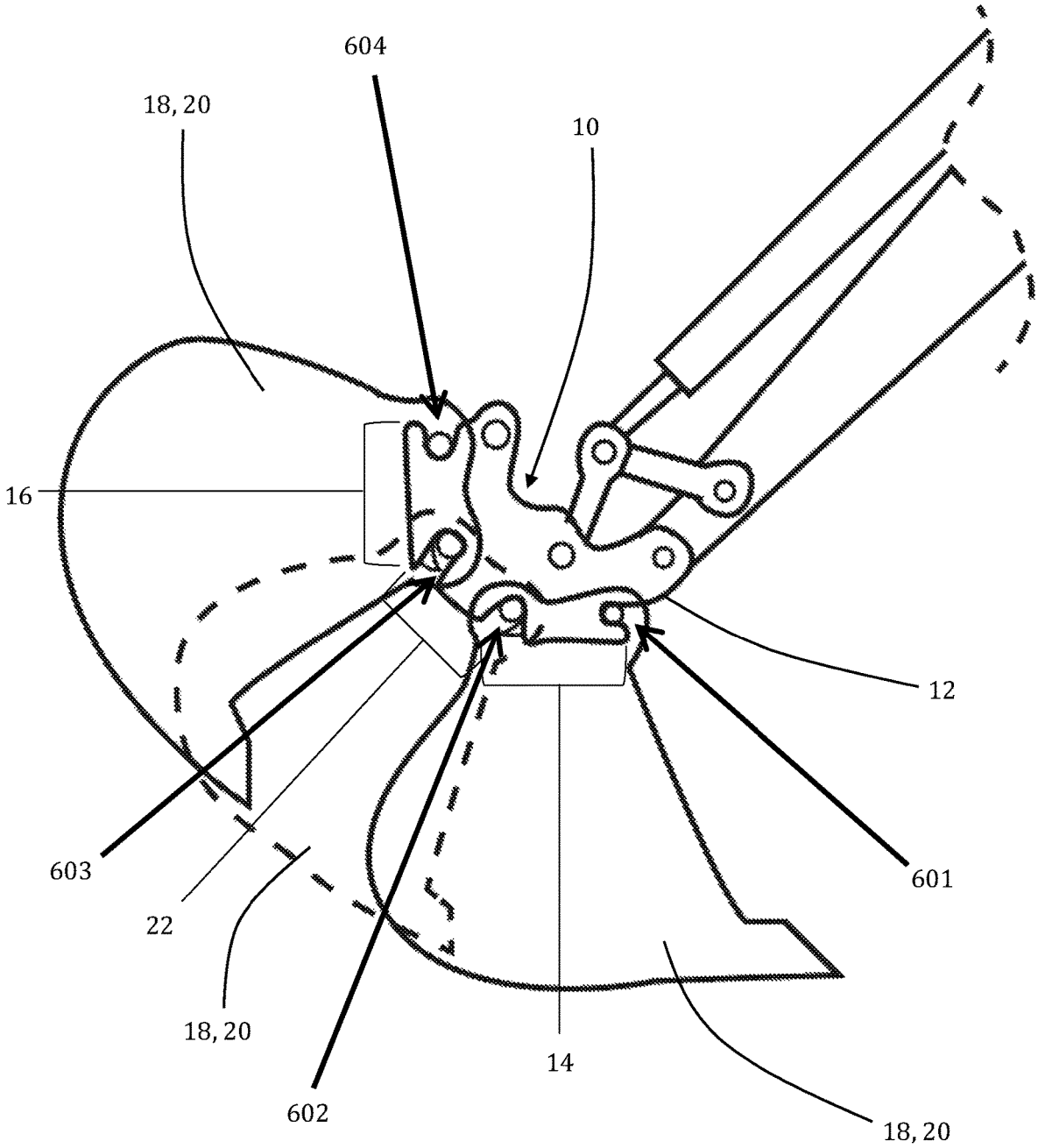
FIG. 3 is a side, cut off view of an embodiment wherein the quick hitch provides/comprises four attachment points, and showing a possible third mounting position arrangement provided by the four attachment point example.
Figure 4:
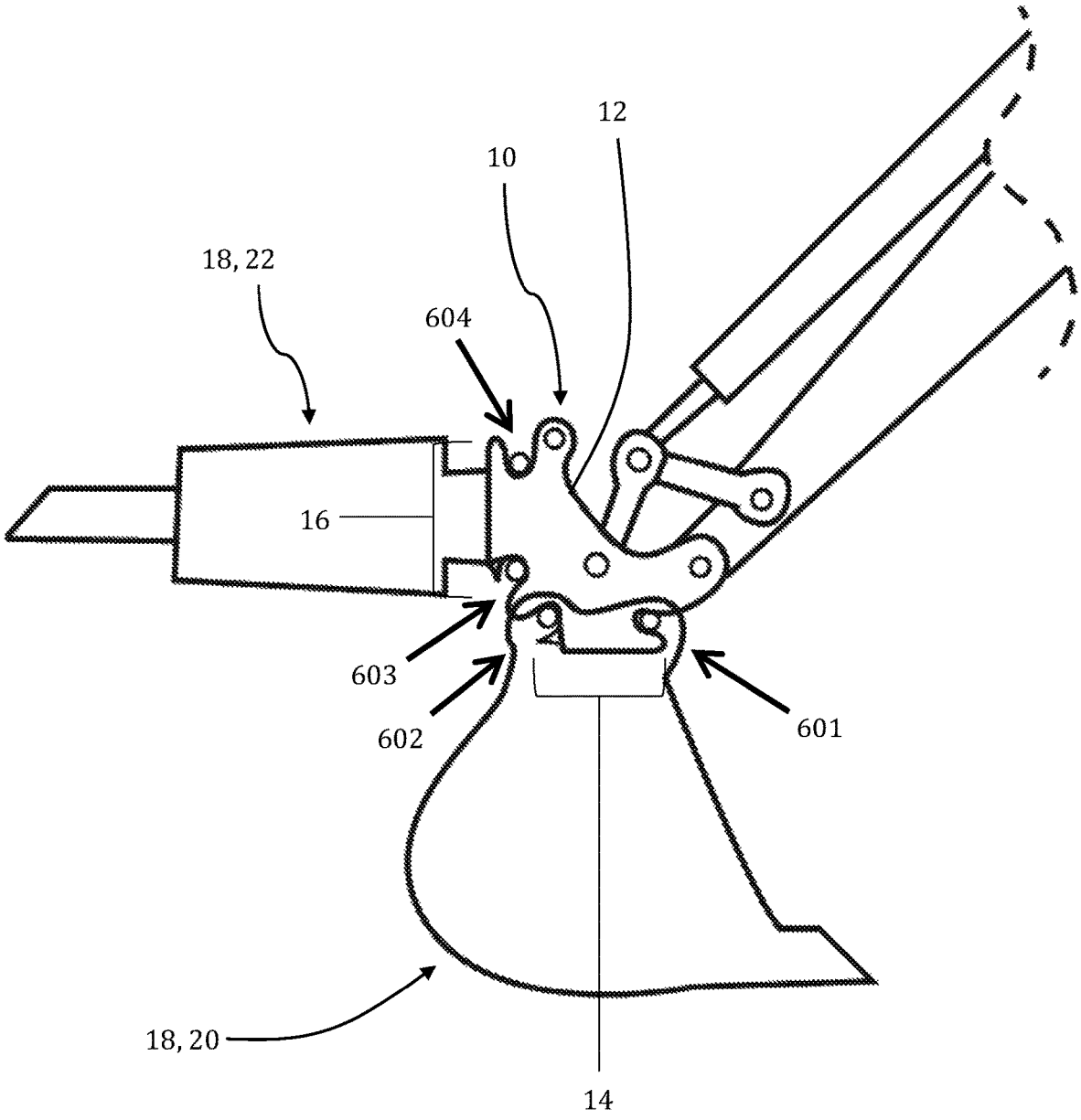
FIG. 4 is a side, cut-off view, showing an embodiment wherein the quick hitch can facilitate use of a rock breaker attachment at a top mounting position, and a bucket attachment in the lower mounting position, attached/mounted simultaneously.

In one preferred embodiment, the first mounting position arrangement and second mounting position arrangement are provided by way of a four attachment point arrangement. This is shown in FIG. 3 and FIG. 4 (as well as FIG. 7), where a first attachment point 601, second attachment point 602, third attachment point 603, and fourth attachment point 604 are clearly shown. By way of example, bucket attachment(s) 18, 20 are shown in the first mounting position, and the second mounting position, here shown in a scooping position/orientation, although any excavator attachment shown in the present application, (whichever orientation it is shown mounted in), (and in fact any excavator attachment), may be either mounted in the standard, or reverse/inverse, position, and may be provided claimed in either/any orientation.

In such an embodiment, the middle two (ie 602, 603) of the four attachment points may be usable as a third mounting position arrangement 22. This is denoted/shown by the dashed depiction of a bucket attachment 18, 20 in FIG. 3, shown mounted in the third mounting position, via attachment points 602, 603.

Preferably the second mounting position arrangement is substantially at 90 degrees to the first mounting position arrangement. This is shown in all the examples shown. The term 'substantially' here means within twenty five degrees of 90 degrees—ie if the first mounting position is a directly downward mounting position, preferably the second mounting position (or any alternate mounting position, which therefore could be called the second mounting position) is between 65 and 115 degrees difference in angle from the first mounting position.

It may be possible for the first mounting position arrangement and the second mounting position arrangement to hold different excavator attachments, simultaneously, for use. Several examples of this are shown or suggested in the Figures. However, the best example is shown in FIG. 4, wherein a bucket attachment 18, 20 is shown in the first mounting position, and a rock breaker attachment 18, 22 is shown in the second mounting position. In this way, an excavator can be operated, with the operator operating the rock breaker attachment to break rock, and then operating the bucket attachment to clear the rock/debris that has been broken by the rock breaker, without ever needing to change/mount attachments during the operation (which would otherwise be required if only one mounting position arrangement were available, and therefore only one attachment usable at a time). This can save a lot of time and labour in operation of an excavator. Thus, as shown, in one example embodiment, the first mounting position 14 arrangement holds an excavator bucket attachment 18, 20, and the second mounting position arrangement 16 holds an excavator rock breaker attachment 18, 22.

The second mounting position arrangement (or any of the mounting position arrangements provided) may be an upright bucket carrying position, where the top (upper) mounting positions are, for the sake of the present application, considered to be upright bucket carrying positions. This is clearly shown in FIG. 1, FIG. 2, and FIG. 5. The first mounting position arrangement (or any of the mounting position arrangements provided) preferably provides a downward mounting position. This is shown clearly in FIG. 1, FIG. 2, FIG. 3, FIG. 4 and FIG. 5, all of which show or denote that an excavator attachment (eg a bucket attachment, or any other excavator attachment) can be mounted downwards, via the quick hitch/quick coupler 10.

As stated, in any given embodiment(s), the quick hitch body 12 may allow for or provide a third mounting position arrangement. An example of this is shown in FIG. 3. However, this is just an example, and it is feasible the quick hitch may comprise a third mounting position arrangement, not limited to the example of FIG. 3, wherein the third mounting position arrangement uses attachment point(s) from the first and second mounting position arrangement. Thus the third mounting position arrangement may comprise its own attachment point(s), not using attachment point(s) from the the first and second mounting position arrangement.

(It will be obvious that the attachment points provided in the present application are provided by way of example, and the mounting position arrangements may use/comprise any mounting/attachment arrangement/means to facilitate mounting/attaching an excavator attachment(s). For example, although the mounting position arrangement examples shown in the drawings tend to comprise two attachment points, it is feasible (especially if a bespoke excavator attachment (eg bespoke bucket attachment) is provided/used with the quick hitch) that the or a mounting position arrangement(s) may, for example comprise more than one attachment point to facilitate attachment, or may, for example, comprise only one attachment point. For example, a (possibly bespoke) excavator attachment (such as a bucket attachment, for example) may be provided that has a surface (or any point) configured to 'lock' (or attach in any way) to a surface (or any point) of the or a mounting position arrangement, perhaps thus not requiring two (or more) attachment points, but instead locking directly from surface (or any point) of the excavator attachment to surface (or any point) of the quick hitch/mounting position. This would be an example of a mounting position arrangement comprising only one attachment point. In a preferred embodiment, the mounting position arrangements comprise two attachment points (as shown in the example Figures). One of the intents of this preferred embodiment is to allow for standard excavator attachments (eg such as bucket attachments) already readily available, and used/owned by many excavator owners and/or operators, to be usable with the quick hitch, without requiring bespoke excavator attachments. Thus the quick hitch mounting position arrangements preferably allow for a standard excavator attachment (eg bucket attachment) to be attached/mounted.)

To describe the Figures in more detail (shown by way of example only), in FIG. 1, what is shown (by way of example) is shown comprising a bucket cylinder 26; a bucket link 28; a tipping link 30; a dipper arm/stick 32; a lifting eye 34; and a bucket (or any excavator attachment) release mechanism 36 (ie an attachment release mechanism 36). The example attachment release mechanism 36 is shown provided at a side of the quick hitch 10 (and thus body 12), but may be provided anywhere about the body 12 of the quick hitch (for a manual type release mechanism), or alternatively an automated release mechanism may be provided, which may be controlled by the operator (eg from inside a vehicle body of an excavator). Any or all of the features shown may be provided.

The bucket 18, 20, in FIG. 1, (shown in the substantially horizontal mounting position), is shown in a reversed bucket position. The dashed bucket 18, 20 of FIG. 1 is shown in a reversed bucket position. Thus it can be seen, the same excavator attachment can be used in either the first, or the second, mounting position. This can be useful, for example, in that having the two mounting positions allows the bucket (and/or a bucket hydraulic cylinder) optimal freedom of movement, whether the bucket is facing the excavator, or facing away from the excavator. Of course, different excavator attachments 18 (not limited to the same bucket attachment) can be used on either of the mounting position arrangements.

FIG. 2 is simply a view of the embodiment as shown in FIG. 1, from a reverse side angle (now with the bucket 18, 20 shown in a standard position on the lower position arrangement). Given that in the embodiment shown in FIG. 1 and FIG. 2, all features are simply the same, shown from the reverse angle (ie preferably the quick hitch 10 is symmetrical), the features are not all numbered since they are clearly the same features as shown (and numbered) in FIG. 1. Thus preferably the quick hitch is symmetrical, although it is feasible the quick hitch may be provided/built in a way that is not symmetrical. It may, feasibly, be close, but not exactly, symmetrical, when viewed from a side angle.

In FIG. 3 (also showing many of the same features, but showing a different embodiment of the quick hitch, in action), it is shown how there can be three mounting position arrangements. In the example, this is achieved via a four attachment point arrangement, wherein the middle two attachment points form (or are used to form) the third mounting position arrangement. Thus it is shown the same (or an alternate) excavator attachment can be used via the plurality of mounting position arrangements. (The four attachment point arrangement providing a third mounting position arrangement is optional).

Referring to FIG. 4, there is shown a very similar/same embodiment of the quick hitch 10 as shown in FIG. 3, now showing a bucket mounted (downwards) in the standard bucket position via the first mounting position arrangement, and a rock breaker attachment mounted via the second mounting position arrangement (preferably substantially horizontally, as shown). Thus, in certain embodiments, two excavator attachments can be used simultaneously via the quick hitch. (It is feasible even more than two excavator attachments could be mounted/attached simultaneously (for use) via the quick hitch). Thus there is shown in FIG. 4 a rock breaker attachment attached in the top mounting position, and a bucket attachment attached at the bottom (lower) mounting position. Thus, in the example, there is no need to change attachments, in use, and no need for two separate excavators to work together, each having one of the two shown attachments. Instead, the arrangements shown allows the excavator to both break rock with the rock breaker 18, 22, then clear the debris with the bucket 18, 20.

Figure 5:
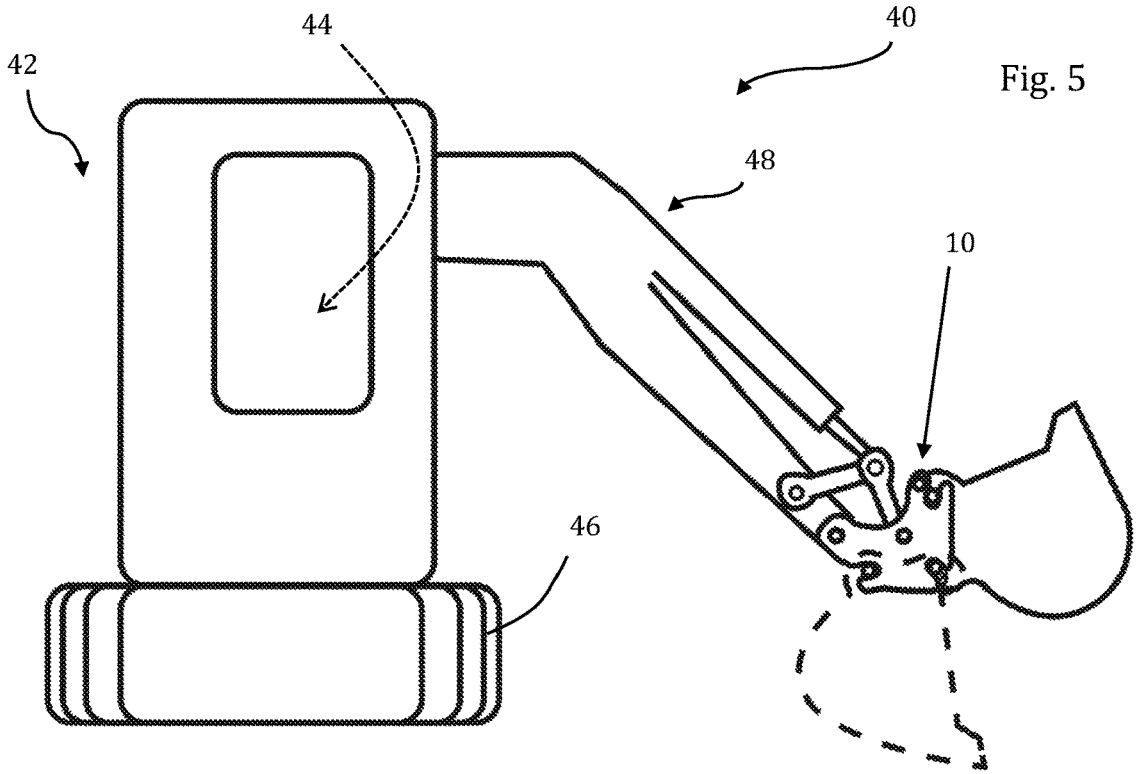
FIG. 5 shows a side view of a basic depiction of an excavator using the quick hitch.

In FIG. 5, an excavator 40 is shown, which comprises the quick hitch 10. The excavator is shown comprising a vehicle body 42. The vehicle body 42 is shown, in the example, comprising an operator's/driver's area 44, and a drive element 46 (which is usually provided by way of a track, but may feasibly comprise wheel(s), or any other drive element). The excavator 40 is shown comprising what is generally termed, for the present application, an arm 48, which is depicted in crude terms for representational purposes only. The arm is shown extending towards the quick hitch 10. There are shown (for representational purposes) an excavator attachment(s) attached via the quick hitch 10, and thus operable.

Figure 6:
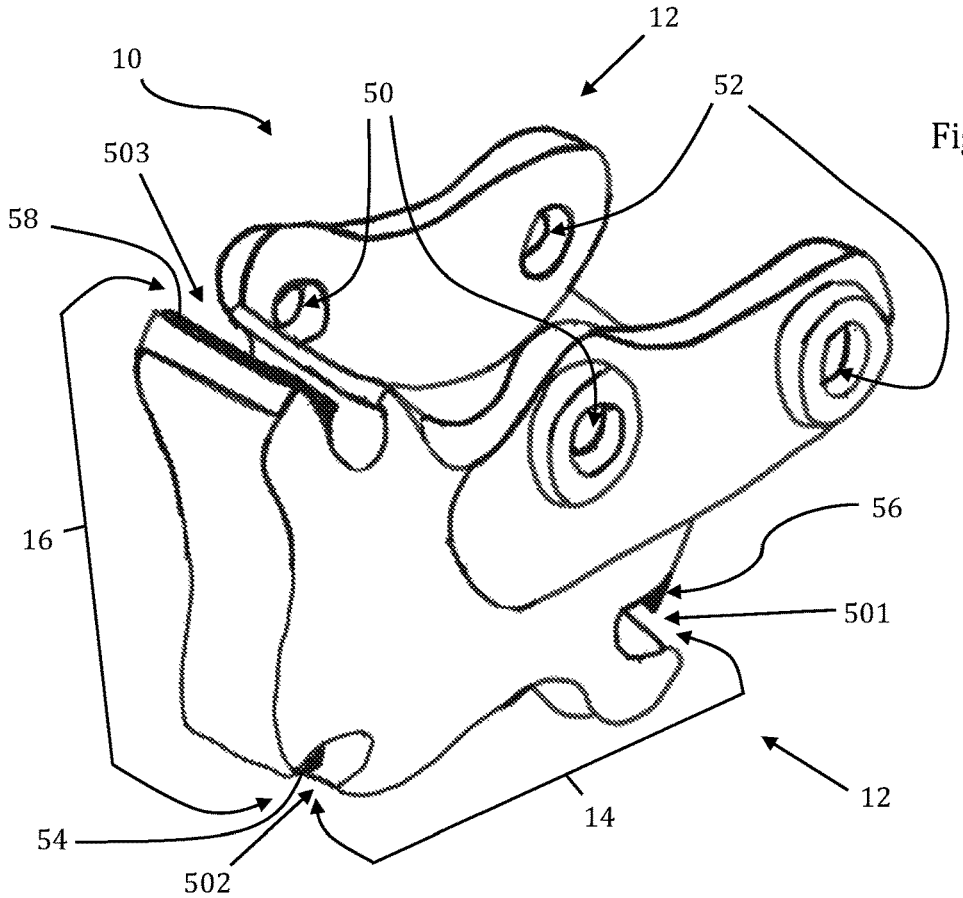
FIG. 6 shows a side perspective view of an example embodiment of the quick hitch, wherein there are provided three attachment points to facilitate the plurality of mounting position arrangements.

Referring to FIG. 6, there is shown an example embodiment of the quick hitch 10 from a side perspective view, wherein the first mounting position arrangement 14 and second mounting position arrangement 16 are provided by way of a three attachment point arrangement, wherein the centre attachment point 502 is used as part of the first and second mounting position arrangement. (Such as, for example, as shown in FIG. 1, FIG. 2, and FIG. 5).

The example of FIG. 6 is shown comprising any or all of: a bucket link attachment arrangement 50 to facilitate attachment to a bucket link (the example shown comprising two (or any amount of) excavator bucket link pin connection position(s)); a dipper arm/stick attachment arrangement 52 to facilitate attachment to a dipper arm/stick (the example shown comprising two (or any amount of) excavator dipper arm/stick pin connection position(s)); a primary locking arrangement for both mounting position arrangements (comprising, in the example, a shown primary locking feature 54); a secondary locking arrangement for the first (lower) mounting position arrangement (comprising, in the example, a shown secondary locking feature 56); and a secondary locking arrangement for the second (upper/top) mounting position arrangement (comprising, in the example, a shown secondary locking feature 58). (Such 'locking arrangement(s)' may be claimed as 'locking mechanism(s)')

Figure 7:
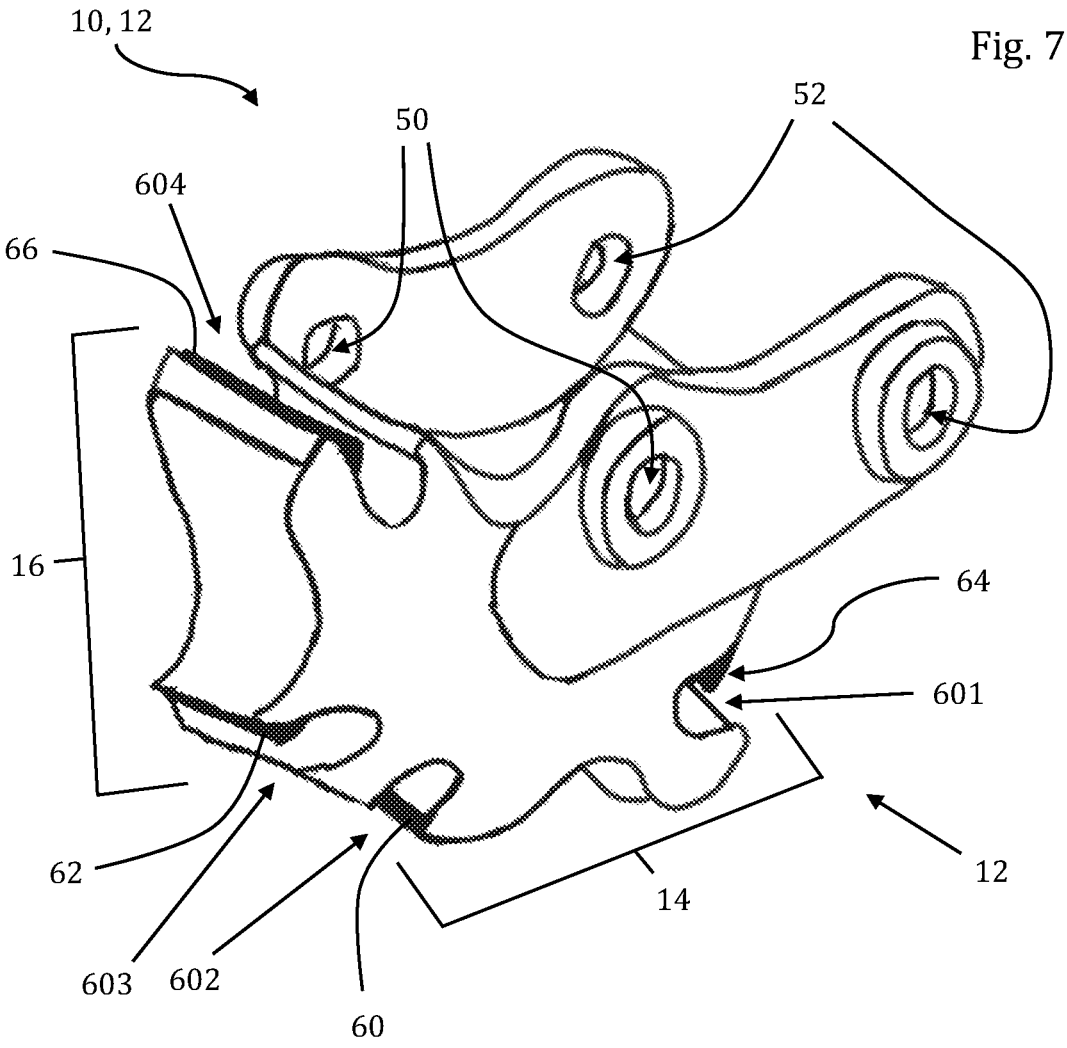
FIG. 7 shows a side perspective view of an example embodiment of the quick hitch, wherein there are provided four attachment points to facilitate the plurality of mounting position arrangements.

Referring to FIG. 7, there is shown an example embodiment of the quick hitch 10 from a side perspective view, wherein the first mounting position arrangement 14 and second mounting position arrangement 16 are provided by way of a four attachment point arrangement. (Such as, for example, as shown in FIG. 3 and FIG. 4). Again, in the example, the first mounting position arrangement 14 is shown comprising attachment points 601 and 602; the second mounting position arrangement 16 is shown comprising attachment points 603 and 604 (as previously shown/described).

Attachment points 602 and 603 may feasibly form a third mounting position arrangement (as described (and shown) particularly with reference to FIG. 3).

The example of FIG. 6 is shown comprising any or all of: a bucket link attachment arrangement 50 to facilitate attachment to a bucket link (the example shown comprising two (or any amount of) excavator bucket link pin connection position(s)); a dipper arm/stick attachment arrangement 52 to facilitate attachment to a dipper arm/stick (the example shown comprising two (or any amount of) excavator dipper arm/stick pin connection position(s)); a primary locking arrangement for the first (lower) mounting position arrangement (comprising, in the example, a shown primary locking feature 60); a primary locking arrangement for the second (upper/top) mounting position arrangement (comprising, in the example, a shown primary locking feature 62); a secondary locking arrangement for the first (lower) mounting position arrangement (comprising, in the example, a shown secondary locking feature 64); and a secondary locking arrangement for the second (upper/top) mounting position arrangement (comprising, in the example, a shown secondary locking feature 66). (locking arrangement(s)' may be claimed as 'locking mechanism(s)').

As stated, the example of FIG. 7 can allow for simultaneous mounting (and usage) of two separate excavator attachments (as shown, for example, in FIG. 4).

The term 'body' is a broad term, and it is feasible the body 12 of the quick hitch may be provided, for example, in multiple parts, coming together to form the quick hitch (and thus to form the quick hitch body), or as one part. For example, referring to FIG. 6 and FIG. 7, if the part(s) of the quick hitch body that comprise the arrangements to facilitate attachment to the bucket link and/or dipper arm/stick are provided as a separate part(s), which is then attached (preferably by welding) to the part(s) of the quick hitch body that comprise the mounting position arrangements, nevertheless, the parts, together, are considered to be part of the quick hitch 10, and thus part of the quick hitch body 12. Thus all that is seen in FIG. 6 and FIG. 7, even if provided as separate parts that are put (eg welded) together, is considered to be the quick hitch body. Thus the quick hitch body may be provided by way of multiple parts, coming together to form the quick hitch body.

(Thus the term 'body' is a broad term, and may be seen interchangeably with the term 'unit'. Thus the quick hitch body may be claimed as a quick hitch unit, and the terms 'body' and 'unit' are seen as interchangeable.)

The example embodiments shown in FIG. 6 and FIG. 7, shown removed from/not attached to the excavator arm, thus show the quick hitch 10 being removably attachable.

It will be obvious to those with skill in the art that the quick hitch 10 may be provided in many different sizes.

In Use

An example(s) will now be described in use, described by way of example only, and in no way limiting a scope of the invention.

Thus, referring in use (by way of example) to a particularly preferred example, comprising four attachment points (as shown, for example, in FIGS. 3, 4 and 7), with both primary and secondary locking mechanisms disengaged on the first mounting position, the machine operator will at first pick up the first attachment using a mounting/attachment point 601 on the bottom (lower) first mounting position arrangement of the quick hitch with one of the pins of the attachment depending on preferred orientation then will by moving the machine allow the excavator attachment to gravitate towards the second mounting/attachment point 602 of the (lower) first mounting position arrangement. Once the correct position has been obtained the machine operator will either manually or automatically engage the locking mechanism depending on the type of quick hitch, securing the first excavator attachment to the first mounting position arrangement of the quick hitch.

Then once the primary and secondary locking mechanisms on/of the second mounting position are disengaged the machine operator will pick up the second excavator attachment using the top mounting point 604 on the top (second) mounting position arrangement of the quick hitch with one of the pins of the attachment depending on preferred orientation, then will by moving the machine allow the excavator attachment to gravitate towards the second mounting point 603 of the second mounting position arrangement. Once the correct position has been obtained the operator will either manually or automatically engage the locking mechanism(s)/arrangement(s) depending on the type of quick hitch, securing the second excavator attachment to the second mounting position arrangement of the quick hitch.

Once both attachments are secured, the operator can choose to use whichever attachment is required by using the excavator bucket cylinder to rotate between them. If the machine operator chooses to connect just one attachment to the quick hitch whilst following the mounting procedure set out above, he/she is free to do so, as both mounting position arrangements have independent locking arrangement(s)/mechanism(s) (which may be automatic and/or semi-automatic and/or manual).

Now referring in use, (by way of example) to another preferred example, comprising three attachment points (as shown, for example, in FIGS. 1, 2 5, and 6), with both primary and secondary locking mechanisms disengaged the machine operator can choose to switch between the first mounting position arrangement and the second mounting position arrangement. To obtain the first mounting position for the attachment, the machine operator ideally picks up the attachment using the back attachment point 501 of the first mounting position arrangement on the bottom of the quick hitch with one of the pins of the attachment depending on the preferred orientation and by moving the machine allow the attachment to gravitate towards the common attachment point 502 at the bottom front of the quick hitch. Once the correct position has been obtained the machine operator will either manually or automatically engage the locking mechanism(s)/arrangement(s) depending on the type of quick hitch. The attachment is now ready to use.

To obtain the second mounting position the machine operator will first disengage the attachment from the first mounting position arrangement and then pick up the same (or any other) attachment, using the top mounting point 503 of the second mounting position arrangement with one of the pins of the attachment depending on the preferred orientation and by moving the machine allow the attachment to gravitate towards the common mounting position 502 at the bottom front of the quick hitch. Once the correct position has been obtained the machine operator will either manually or automatically engage the locking mechanism(s)/arrangernent(s) depending on the type of quick hitch. The attachment is now ready to use.

The embodiments described above are provided by way of example only, and various other modifications will be apparent to persons skilled in the art without departing from the scope of the invention as defined in the appended claims.

Adjectival and Adverbial Use, in the Present Application, is Innately Optional

In the present application, adjectival definition of a noun in no way limits the ability to claim the noun, without the adjective. Thus if a 'curved edge' is disclosed, it should be understood that it is disclosed simply by way of example, as an embodiment of 'an edge', and that an invention may be claimed, comprising an 'edge', and not limited to comprising a 'curved edge', even if the only disclosure in the specification is of a 'curved edge'. This goes for every single adjective example in the present application, and also applies to adverbs in the same way, with reference to how they limit a broader verb/action, which verb/action/characterizing feature may be included in a claim (and is supported), not limited by the adverb that further defines it.

The Title of the Present Application Does Not Limit What May be Claimed

The title of the present application (and the claims presented) do not limit what may be claimed futurely, based upon (and supported by) the present application. For example, if the title is 'Pet Cleaning Apparatus', even if all disclosure in the patent application relates to a pet cleaning apparatus (as do the claims), nevertheless, a 'cleaning apparatus' may be claimed (not limited to being for pets), as it is clear a 'pet cleaning apparatus' is an embodiment of a 'cleaning apparatus'. As stated previously, in the present application, adjectival definition of a noun in no way limits the ability to claim the noun, without the adjective. This also applies to the title. Thus, for example, a 'quick hitch', (not limited to use for excavators), may be claimed, as may a quick hitch, comprising any feature or combination of features disclosed in the present application, whether or not it provides a plurality of mounting positions. Furthermore, an invention may be claimed (which is not a quick hitch), comprising any feature, or combination of features, disclosed in the present application.

The invention claimed is:

1. An excavator quick hitch, comprising:

a quick hitch body comprising four arrangements:

a dipper arm/stick attachment arrangement to facilitate attachment of the said quick hitch body to a dipper arm/stick; and, a first mounting position arrangement comprising at least two attachment points for attaching an excavator attachment to the quick hitch body in a first mounting position;

a second mounting position arrangement comprising at least two attachment points for attaching the same, or an alternate, excavator attachment to the quick hitch body in a second mounting position;

a third mounting position arrangement comprising at least two attachment points for attaching the same, or an alternate, excavator attachment to the quick hitch body in a third mounting position; and wherein the first mounting position arrangement and the second mounting position arrangement are substantially at 90 degrees to each other, and wherein there is no shared arrangement portion between the dipper arm/stick attachment arrangement and the mounting position arrangements.

2. An excavator quick hitch as claimed in claim 1, wherein the third mounting position arrangement is provided between the first mounting position arrangement and the second mounting position arrangement.

3. An excavator quick hitch as claimed in claim 1, wherein the three mounting position arrangements are provided by way of a four attachment point arrangement, wherein the middle two of the four attachment points are usable as the third mounting position arrangement.

4. An excavator quick hitch as claimed in claim 1, wherein two of the three mounting position arrangements hold different excavator attachments, simultaneously, for use.

5. An excavator quick hitch as claimed in claim 4, wherein, of the two mounting position arrangements that hold different excavator attachments, simultaneously, for use, one of the mounting position arrangements holds an excavator bucket attachment, and the other of the mounting position arrangements holds an excavator rock breaker attachment.

6. An excavator quick hitch as claimed in claim 1, wherein one of the three mounting position arrangements is an upright bucket carrying position.

7. An excavator, comprising:

an excavator vehicle body;

an arm extending from the vehicle body; and an excavator quick hitch as claimed in claim 1.

8. An excavator quick hitch, comprising:

a quick hitch body comprising three arrangements:

a dipper arm/stick attachment arrangement to facilitate attachment of the said quick hitch body to a dipper arm/stick; and, a first mounting position arrangement comprising at least two attachment points for attaching an excavator attachment to the quick hitch body in a first mounting position;

a second mounting position arrangement comprising at least two attachment points for attaching the same, or an alternate, excavator attachment to the quick hitch body in a second mounting position;

wherein there is a shared mounting position arrangement portion, shared between the first mounting position arrangement and the second mounting position arrangement, the shared portion being substantially central between the first mounting position arrangement and the second mounting position arrangement;

wherein there is no shared arrangement portion between the dipper arm/stick attachment arrangement and the mounting position arrangements; and, wherein the second mounting position arrangement is substantially at 90 degrees to the first mounting position arrangement.

9. An excavator quick hitch as claimed in claim 8, wherein the shared portion comprises an attachment point.

10. An excavator quick hitch as claimed in claim 9, wherein the attachment point of the shared portion is a central attachment point.

11. An excavator quick hitch as claimed in claim 10, wherein the first mounting position arrangement and second mounting position arrangement are provided by way of a three attachment point arrangement, and the central attachment point is the central attachment point of the three attachment points.

12. An excavator quick hitch as claimed in claim 8, wherein one of the mounting position arrangements is an upright bucket carrying position.

13. An excavator, comprising:

an excavator vehicle body;

an arm extending from the vehicle body; and an excavator quick hitch as claimed in claim 8.

14. An excavator quick hitch, comprising:

a dipper arm/stick attachment arrangement to facilitate attachment of a quick hitch body to a dipper arm/stick;

the quick hitch body comprising two arrangements:

a first mounting position arrangement comprising at least two attachment points for attaching an excavator attachment to the quick hitch body in a first mounting position; and a second mounting position arrangement comprising at least two attachment points, suitable both for attaching the same, or an alternate, excavator attachment to the quick hitch body in a second mounting position;

wherein the quick hitch is configured to allow for mounting of a first excavator attachment to the first mounting position arrangement, and a second excavator attachment to the second mounting position arrangement, simultaneously, for use;

wherein the second mounting position arrangement is substantially at 90 degrees to the first mounting position arrangement; and, wherein there is no shared arrangement portion between the dipper arm/stick attachment arrangement and the mounting position arrangements.

15. An excavator quick hitch as claimed in claim 14, wherein the first mounting position arrangement and the second mounting position arrangement each comprise two attachment points, configured to facilitate attachment of an excavator attachment.

16. The first mounting position arrangement and the second mounting position arrangement as claimed in claim 15, wherein the two attachment points of are pin-receiving attachment points, for receiving a pin of an excavator attachment.

17. An assembly, comprising:

an excavator quick hitch as claimed in claim 14;

a first excavator attachment removably attached to the first mounting position arrangement; and a second excavator attachment removably attached to the second mounting position arrangement;

the excavator attachments attached simultaneously, for use.

18. An assembly as claimed in claim 17, wherein the first excavator attachment and the second excavator attachment are different types of excavator attachment.

19. An assembly as claimed in claim 18, wherein one of the excavator attachments is an excavator bucket attachment, and the other excavator attachment is an excavator rock breaker attachment.

20. An excavator, comprising:

an excavator vehicle body;

an arm extending from the vehicle body; and an excavator quick hitch as claimed in claim 14.

21. An excavator, comprising:

an excavator vehicle body;

an arm extending from the vehicle body; and an excavator quick hitch as claimed in claim 15.

22. An excavator, comprising:

an excavator vehicle body;

an arm extending from the vehicle body; and an excavator quick hitch as claimed in claim 17.

23. An excavator, comprising:

an excavator vehicle body;

an arm extending from the vehicle body; and an assembly as claimed in claim 18.

24. An excavator, comprising:

an excavator vehicle body;

an arm extending from the vehicle body; and an assembly as claimed in claim 19.

* * * * *